US010190818B2

(12) United States Patent
Parker et al.

(10) Patent No.: US 10,190,818 B2
(45) Date of Patent: Jan. 29, 2019

(54) CONTAINER SPINNING DEVICE AND METHOD OF USE THEREOF

(71) Applicants: Tyler Scott Parker, Elkton, FL (US); Trevor William Abbott, New Port Richey, FL (US)

(72) Inventors: Tyler Scott Parker, Elkton, FL (US); Trevor William Abbott, New Port Richey, FL (US)

(73) Assignee: Spin Chill Corp., Gainesville, FL (US)

( * ) Notice: Subject to any disclaimer, the term of this patent is extended or adjusted under 35 U.S.C. 154(b) by 295 days.

(21) Appl. No.: 14/302,306

(22) Filed: Jun. 11, 2014

(65) Prior Publication Data

US 2014/0360711 A1 Dec. 11, 2014

Related U.S. Application Data

(60) Provisional application No. 61/833,520, filed on Jun. 11, 2013, provisional application No. 61/833,784, filed on Jun. 11, 2013, provisional application No. 61/905,141, filed on Nov. 15, 2013.

(51) Int. Cl.
*F25D 31/00* (2006.01)

(52) U.S. Cl.
CPC ..... *F25D 31/007* (2013.01)

(58) Field of Classification Search
CPC ..... F25D 31/006; F25D 31/007; F25D 11/00
USPC ..... 165/80.5, 185; 62/62, 457.3, 457.4, 62/457.8; 366/218; 269/287; 220/592.16
See application file for complete search history.

(56) References Cited

U.S. PATENT DOCUMENTS 511,209 A * 12/1893 Parker ..... F25D 3/08 62/378
714,415 A * 11/1902 Trafford ..... F25D 3/06 366/214
2,216,762 A * 10/1940 Bolas ..... F25D 31/007 366/149
2,405,091 A * 7/1946 Culbreth ..... F25D 31/007 134/187
2,746,330 A 5/1956 Pfetzing
4,580,405 A * 4/1986 Cretzmeyer, III .... F25D 31/007 62/381
4,688,395 A 8/1987 Holcomb
4,825,665 A * 5/1989 Micallef ..... F25D 3/06 62/372

(Continued)

FOREIGN PATENT DOCUMENTS

WO 2003070027 A1 8/2003

*Primary Examiner* — Claire Rojohn, III
(74) *Attorney, Agent, or Firm* — Maxwell L. Minch; Gray-Robinson, P.A.

(57) ABSTRACT

Devices and methods for spinning food and beverage containers to accelerate heat transfer between the container and its surroundings is provided. The devices include a cylindrical sleeve which positively engages one end of a container, where the cylindrical sleeve is capable of holding an end of a can, an end of a bottle, or both. The cylindrical sleeve is connected to a shaft which in turn is connected to a rotating device, or the shaft is capable of being connected to a rotating device. Cans or bottles are held by the cylindrical sleeve of the inventive devices and are rotated in a heated or cooled medium which increases the rate of heat transfer between the contents of the can or bottle and the medium.

4 Claims, 10 Drawing Sheets

(56) References Cited

U.S. PATENT DOCUMENTS 4,951,890 A * 8/1990 Sossamon ..... A01K 89/003 242/250
5,005,378 A * 4/1991 Ottenheimer ..... F25D 3/08 62/378
5,054,733 A * 10/1991 Shields ..... B60N 3/101 248/154
5,282,368 A 2/1994 Ordoukhanian
5,317,964 A 6/1994 Prudhomme
5,469,935 A * 11/1995 Hewuse ..... B01D 35/31 141/86
6,266,879 B1 * 7/2001 Scudder ..... A47J 36/28 29/890.03
6,314,751 B1 * 11/2001 Gjersvik ..... F25D 3/02 62/372
6,662,574 B2 12/2003 Loibl et al.
7,086,622 B1 * 8/2006 Whaley ..... A01K 97/00 242/323
7,404,345 B1 * 7/2008 Dipprey ..... B67B 7/16 81/3.09
7,637,120 B1 * 12/2009 Doss ..... F25D 3/02 62/378
8,621,885 B1 * 1/2014 Niebolte ..... F25D 31/002 62/457.4
9,528,757 B2 * 12/2016 Dieckmann ..... F25D 31/007
9,845,988 B2 * 12/2017 Shuntich ..... F25D 31/007
2001/0036124 A1 * 11/2001 Rubenstein ..... A47G 19/2205 366/205
2006/0059944 A1 * 3/2006 Taylor ..... A47G 23/0313 62/457.4
2007/0144310 A1 * 6/2007 Pozgay ..... B25B 21/00 81/57.26
2009/0056369 A1 * 3/2009 Fink ..... F25D 17/02 62/457.4
2010/0018223 A1 * 1/2010 Sundhar ..... F25D 31/007 62/3.63
2010/0319363 A1 * 12/2010 Dieckmann ..... F25D 31/007 62/56
2011/0245833 A1 * 10/2011 Anderson ..... B23B 49/02 606/80
2013/0206779 A1 * 8/2013 Wheeland ..... F25D 3/08 220/592.16
2014/0166672 A1 * 6/2014 Stroucken ..... A47G 23/0313 220/592.01
2014/0360711 A1 * 12/2014 Parker ..... F25D 31/007 165/185

* cited by examiner

CONTAINER SPINNING DEVICE AND METHOD OF USE THEREOF

CROSS-REFERENCE TO RELATED APPLICATIONS

The present application claims priority of U.S. Provisional patent application No. 61/833,520 filed Jun. 11, 2013, U.S. Provisional patent application No. 61/833,784 filed Jun. 11, 2013 and U.S. Provisional patent application No. 61/905,141 filed Nov. 15, 2013, the contents of which are herein incorporated by reference.

FIELD OF THE INVENTION

The present invention relates to devices and methods for affecting heat transfer of containers, and more particularly, to a portable devices for affecting the heat transfer from storage containers holding food or beverages.

BACKGROUND OF THE INVENTION

Rapid heating or cooling of contents within containers, and more particularly cylindrical containers such as beverage cans or bottles, has plagued beverage consumers for years. Due to the rate of heat transfer dictated by container properties, the method of employing heat transfer, and because there is no compact refrigeration equipment at least in the sense of cooling, people often are having to deal with drinking beverages whose temperatures are inadequate to their liking.

In this regard, most people resort to submerging their beverages in a warmer or cooler medium to affect heat transfer toward the temperature of their preference, but most methods employed require a long time period to change the contents of container's temperature, and worse, an uneven heating or cooling within the affected container.

For instance, as it pertains to cooling, the most common method employed for cooling a container to a desired temperature, such as a beverage container, requires the use of a cooler filled with ice. A person will submerge their warm beverage container into such cooler full of ice and wait for said beverage can to cool. Depending upon preference this method may take anywhere between 30 minutes to 1 hour to reach the desired temperature. The experienced user of ice coolers, such as a tailgater, realizes that the speed of the cooling may be increased by the intermittent spinning of the can axially about the beverage containers longitudinal axis. However the achieved time savings employing this assisted method is minimal, since the rotation of the can in the ice is intermittent and at a low number of revolutions per minute.

Another method often employed for cooling a beverage is the exposure of the beverage containing container to cold air in a refrigerator or freezer. Again this method achieves to cool the outside of the container, leaving conductive heat transfer to do its slow work within the container. Thus to achieve the desired temperature often takes a long period of time. Moreover, often a user tends to forget placing the container being cooled in the freezer, and in the instance of most carbonated beverages, the container explode, leaving an undesirable mess for the user to clean.

In the sense of heating the contents within the container, one method often employed is the use of a microwave. The microwave, however, causes uneven heating within the container. As a result of this uneven heating, it is quite common to find scalding hot pockets of the heated material mixed amongst warmer and cold pockets of the contents. One example where this phenomenon is witnessed is baby formula, which has spawned the requirement of warnings on the formula containers warning consumers to refrain from microwaving the infant drink. Nonetheless, the microwave method is further limited due to certain containers not having the ability to be placed into the microwave, such as metallic containers, or containers which may easily melt.

Several methods have been employed to speed up or affect the process of heat transfer, the most successful being inducing convective heat transfer. For example, U.S. Pat. No. 4,580,405 provides such methods and devices for practicing same. One such drawback, therein, is that the device and method employed does not make portable use easy. Not only does the device require 120 volts of alternating current (VAC) power to rotate the motor, but it also requires the use of a small container for holding the cooling medium (ice, as taught). In addition, the claimed device employs the use of a suction cup to hold the top of the beverage container, thus it does not physically clip to the can, and the container often comes separated from the suction cup several times during the spinning/cooling process. Moreover the taught device and method cannot accommodate for several sized cans, nor a bottle top or mouth, and cannot be used for containers which already have been opened. Thus the device is limited to spinning the tops of closed beverage cans.

Other methods employed to provide similar solutions claim portability, but all require the use of a self contained container for holding ice, which also provide a counter-motive force to overcome the spinning torque of the motor. As a result the motor assembly of these devices, while it may be removable, cannot be used without the accompanying container for holding the cooling or heating medium, because if used without, the motor would simply spin in place without spinning the container to be cooled, or require a user to hold the motor assembly to provide the counter-motive force to the motor torque. In addition, other methods employed cannot interchangeably be used for spinning objects of varying sizes, such as baby bottles, the neck or mouth of glass or plastic bottles, 12 ounce cans, 12 ounce bottles, and 750 milliliter wine bottles with one single apparatus. Finally, some methods use purely gripping a can without positively engaging the container, the likes of which allow for containers to slip out of a container holder when held upright.

Thus there exists a need for a truly portable container spinning device, which does not require AC power while being used, that can be used with any size container, irrespective of whether the container is open. There additionally exists a need for a container spinning device which positively engages a container to allow the container to remain positively engaged when being held in the upright position. Furthermore there exists a need for a portable container spinning device which employs a method of holding any sized container that prevents the container slipping when exposed to a resistance during the heating or cooling process. Finally, there further exists a need for a portable device which provides a counter-motive force preventing the motor from spinning freely, thus allowing the spinning of container to affect heat transfer virtually anywhere and without additional devices or attachments. No such container spinning apparatus has been presented to date to address these issues, thus there remains an unmet need.

SUMMARY OF INVENTION

A cylindrical sleeve for holding a distal end of a container is provided, the sleeve positively and mechanically engaging the container. In at least one embodiment the cylindrical sleeve is made of a material to overcome slip of the container within the sleeve when being spun while some amount of resistance is applied against the container. The cylindrical sleeve may be made from several known materials. In at least one embodiment the cylindrical sleeve may be made from a rubber, a plastic, a polymer, polyurethane, poly vinyl chloride (PVC), or combinations thereof. In at least one embodiment, the cylindrical sleeve is made with polycarbonate plastic center surrounded by the softer plastic PVC. In at least one embodiment, the cylindrical sleeve contains a bottle clip that positively and mechanically engages the mouth of a bottle extending from a bottles neck.

In at least one embodiment, the cylindrical sleeve further contains a can clip, which includes an undercut in the cylindrical sleeve which clips to the ring typically found on the top of a can, thus positively and mechanically engaging the top of a can into the cylindrical sleeve to hold and prevent the can from inadvertently coming out of the cylindrical sleeve. The cylindrical sleeve is capable of holding a can, a bottle, or a jar. In at least one embodiment, the cylindrical sleeve is capable of holding containers having a distal end diameter between 1.5 to 3.5 inches. In at least one embodiment, the cylindrical sleeve bottle clip is capable of holding the neck and mouth of a bottle. In at least one embodiment, the cylindrical sleeve bottle clip is capable of holding containers having a distal end diameter between 0.5 to 1.5 inches. In at least one embodiment, the cylindrical sleeve further provides a seal when installed on an open can or bottle, such that the can or bottle may be cooled or heated if open, without spilling the contents of the container. In at least one embodiment, the cylindrical sleeve may be shaped like a cone. In at least one embodiment, the cylindrical sleeve may further grip a container in addition to positively and mechanically engaging the container.

In at least one embodiment the cylindrical sleeve is used in combination with a shaft having two ends, a first end of the shaft connected to the cylindrical sleeve and a second end capable of being connected to a rotating device for spinning, such as a motor, a drill, or a wheel. In at least one embodiment the shaft and the cylindrical sleeve form a drill bit. In at least one embodiment the shaft and the cylindrical sleeve are connected to a motor, forming a motor assembly. In at least one embodiment, the motor assembly further includes of a handle that extends perpendicular from the shaft, the handle providing a counter-motive force against a surface preventing the motor from spinning freely when in use to spin a container about its longitudinal axis while the container rests horizontally in a cooling or heating medium, or at a container angle ranging between horizontal and vertical. In at least one embodiment the handle forms an 'L' shape providing a counter-motive force against a surface preventing the motor from spinning freely when in use to spin a container about its longitudinal axis while the container sits vertically in a cooling or heating medium. The 'L' shaped handle may include a mechanism similar to a blade, paddle, or spoon which can be used to provide the necessary counter-motive force in a medium when being used to spin a container vertically, hands-free. In at least one embodiment the motor assembly is powered by a switch that does not need to be engaged in order for the motor to turn, thereby allowing the motor assembly to continuously operate without further interaction by a user.

A method is provided for heating or cooling a container by connecting the cylindrical sleeve to the first end of a shaft, connecting the second end of shaft to a rotating device, inserting a distal end of a container into the cylindrical sleeve, applying the container to a heating or cooling source; and operating the rotating device, whereby the container is rotated about its horizontal axis as a result of the frictional force between the cylindrical sleeve and the container while the container is being exposed to the heating or cooling source.

In at least one embodiment the method of heating or cooling a container employs a drill bit assembly, connecting the drill bit to a drill, inserting a distal end of a container in to the cylindrical sleeve of the drill bit assembly, applying the container to a heating or cooling source, and operating the drill thus affecting the rate of heat transfer while the container is being exposed to the heating or cooling source.

In at least one embodiment, the method or cooling a container employs the use of a motor assembly, inserting a distal end of a container in to the cylindrical sleeve of the motor assembly, applying the container to a heating or cooling source, and operating the motor assembly.

BRIEF DESCRIPTION OF THE DRAWINGS

FIG. 1A represents the top view of the 101 cylindrical sleeve. FIG. 1B represents the bottom view of at least one 101 cylindrical sleeve, illustrating grooves flexible for allowing the 101 cylindrical sleeve to hold various sized 301 containers. FIG. 1C represents the bottom view of at least one 101 cylindrical sleeve to hold a 301 container.

FIG. 4A represents a 201 shaft having two ends, the second end of said 201 shaft connected to a 401 motor having a 402 handle for providing counter-motive force. FIG. 4B represents the 403 motor assembly, as fully assembled, having a 101 cylindrical sleeve connected to a first end of a 201 shaft, and a 401 motor connected to a second end of the 201 shaft, said 403 motor assembly having a 402 handle for providing counter-motive force FIG. 5 provides a cross-sectional, fully assembled, view of the 403 motor assembly having a 402 handle in use with a 301 container inserted into the 101 cylindrical sleeve.

DETAILED DESCRIPTION OF THE INVENTION

The following detailed description is merely exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

Various terms used throughout the specification and claims are defined as set forth below as it may be helpful to an understanding of the invention.

Figure 8:
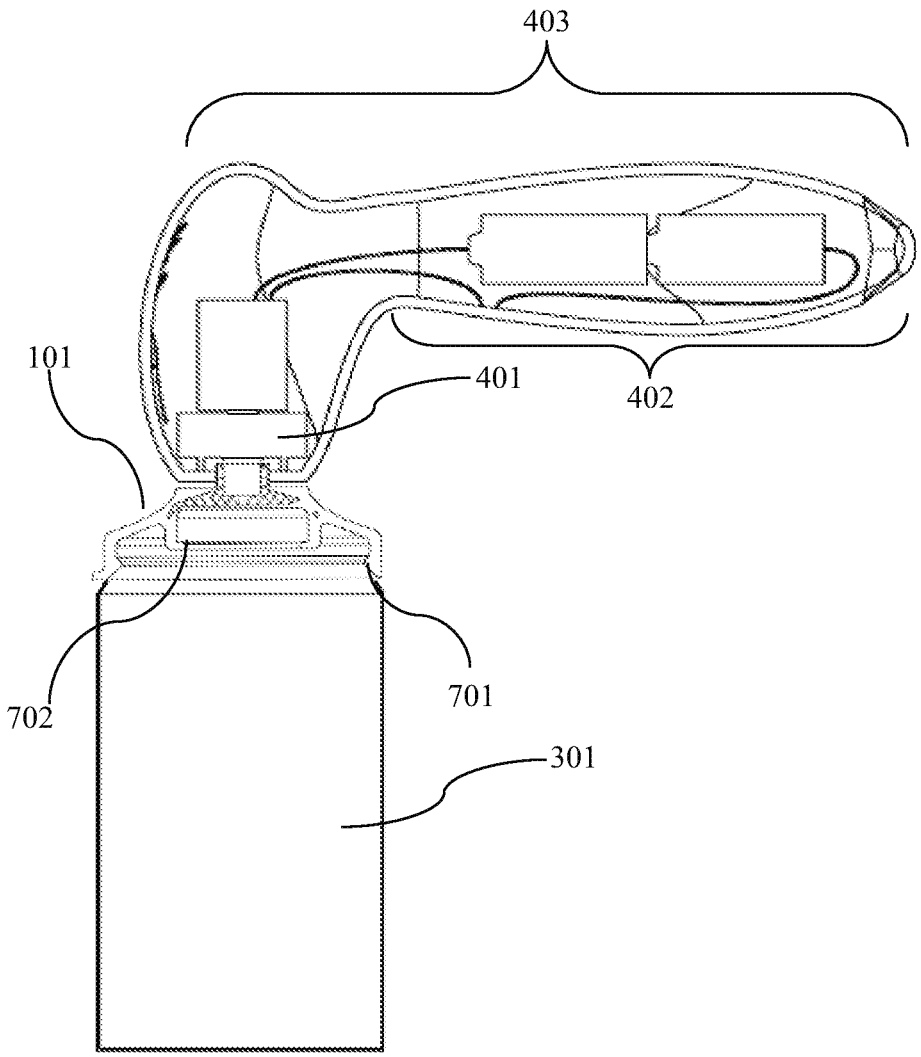
FIG. 8 provides a cross-sectional, fully assembled, view of the 403 motor assembly having a 402 handle in use with a 301 container inserted into the 101 cylindrical sleeve which has a 701 can clip and a 702 bottle clip illustrating the 701 can clip positively mechanically engaging the 301 container, wherein the 301 container is a can.
Figure 9:
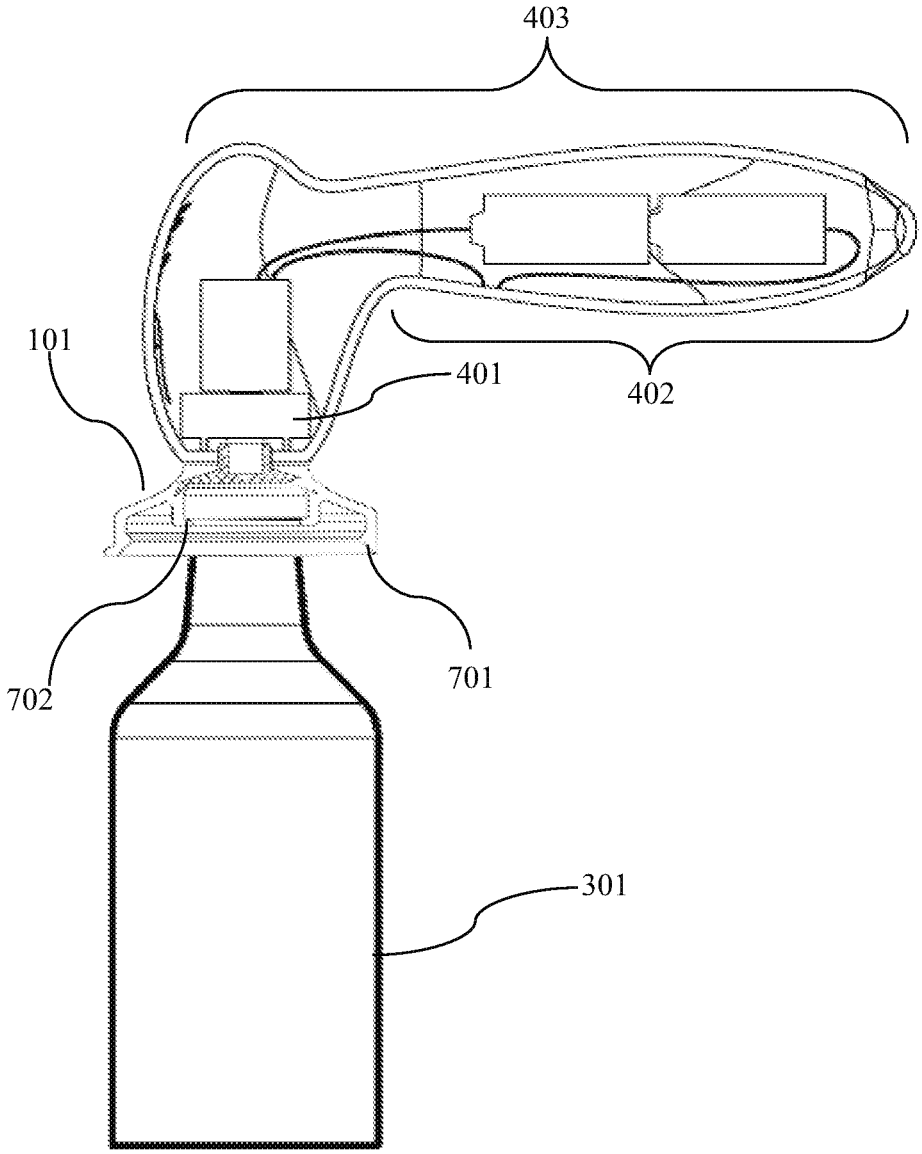
FIG. 9 provides a cross-sectional, fully assembled, view of the 403 motor assembly having a 402 handle in use with a 301 container inserted into the 101 cylindrical sleeve which has a 701 can clip and a 702 bottle clip illustrating the 702 bottle clip positively mechanically engaging the 301 container, wherein the 301 container is a bottle.
Figure 10:
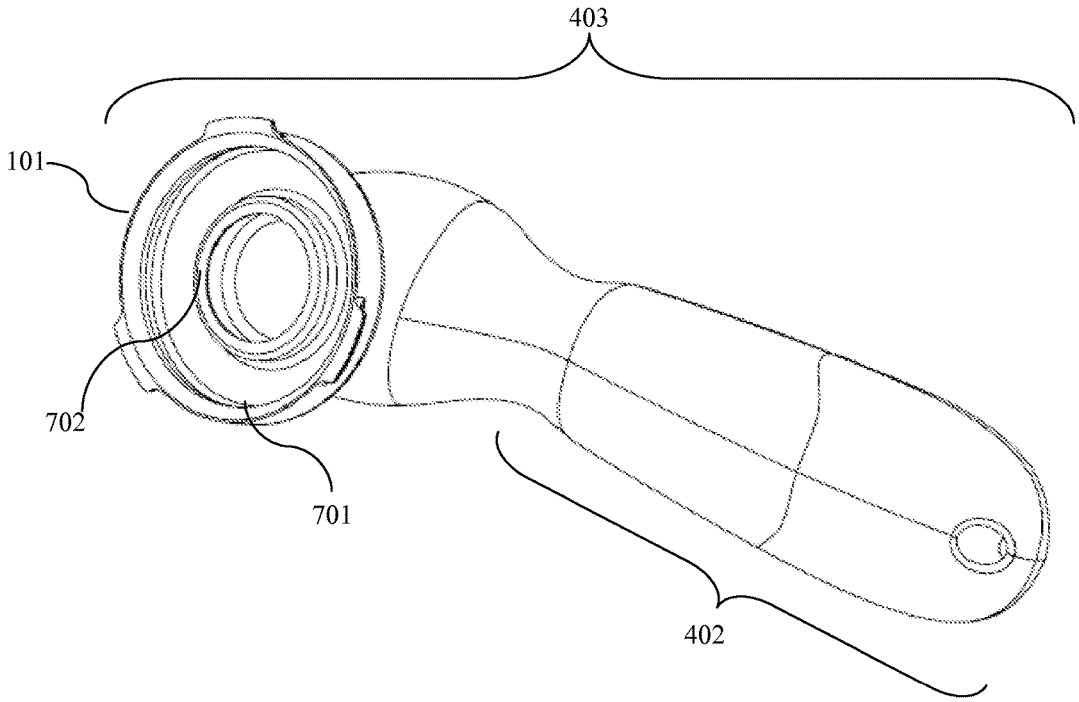
FIG. 10 provides a cross-sectional, fully assembled, view of the 403 motor assembly having a 402 handle featuring the 101 cylindrical sleeve which has a 701 can clip and a 702 bottle clip.

As used herein, "positively engaging" or "positively mechanically engaging" shall mean to hold a control surface or lip of a container without necessarily gripping the container. By way of example, FIG. 8 illustrates the 701 can clip of the 101 cylindrical sleeve holding the folded metal edge of the 301 container where the 301 container is a can. Similarly, FIG. 9 illustrates the 702 can clip of the 101 cylindrical sleeve positively mechanically engaging the flanged or raised surfaces of the 301 container where the 301 container is a bottle. It should be appreciated that the effect of the positively mechanically engaging of the container allows for the container to be held by the cylindrical sleeve without requiring any positive compressive force, or grip, to hold the container.

As used herein, "sleeve" or "cylindrical sleeve" shall mean a cylindrical apparatus capable of sliding over the outside of a cylindrical container. The cylindrical sleeve can be made of one or more of several materials, said materials comprising, wood, plastic, rubber, a polymer, a polyurethane, a latex, a nitrile, a poly-vinyl chloride (PVC), or combinations or equivalents thereof. The cylindrical sleeve can be made to fit over containers of several sizes. One or several cylindrical sleeves can be made to fit over containers of several sizes. Examples of containers include 8 ounce cans, 12 ounce cans (such as aluminum soda cans or aluminum beer cans), 16 ounce cans, 12 ounce bottles (such as glass beer bottles, glass soda bottles, or plastic baby bottles), 14 ounce bottles, 16 ounce bottles, 750 milliliter bottles (such as wine bottles or liquor bottles), 1 liter bottles (such as soda containers or liquor bottles), and 2 liter bottles.

Figure 3:
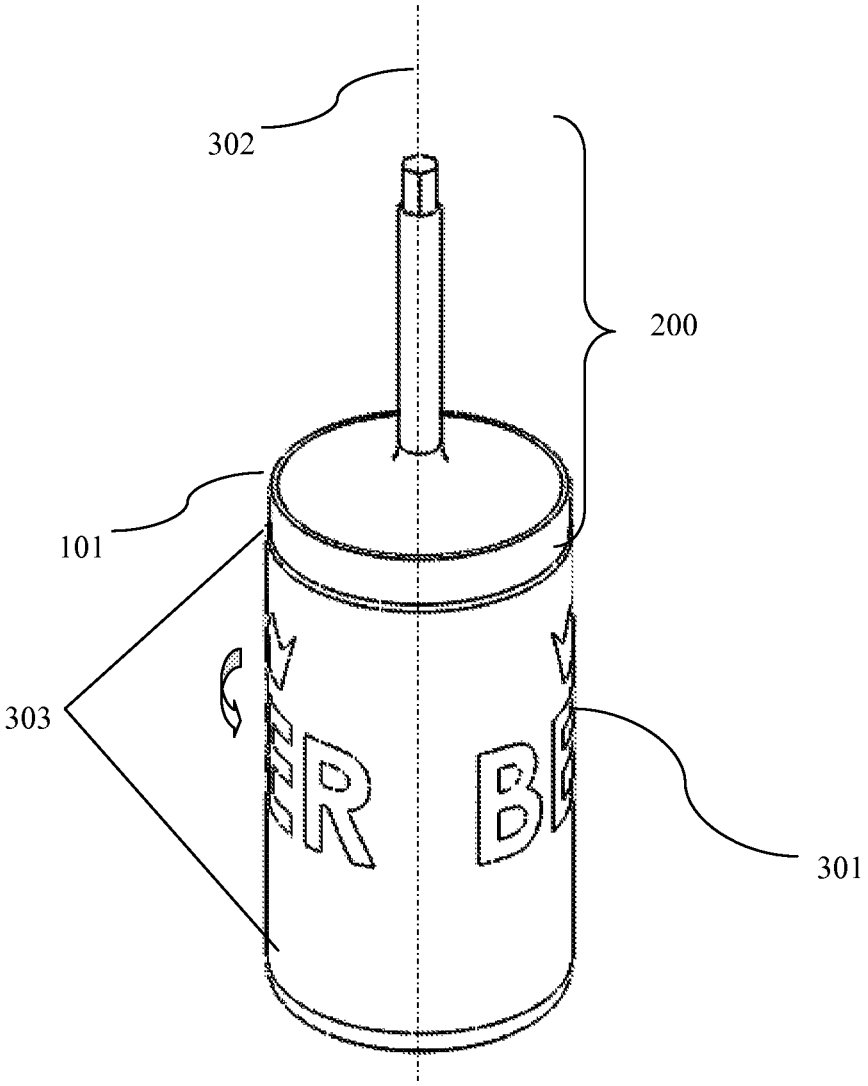
FIG. 3 illustrates a side profile view of a 200 drill bit assembly whereby a 301 container is being connected to said 101 cylindrical sleeve from a 303 distal end, and said 301 container is being spun vertically about its 302 longitudinal axis.
Figure 6:
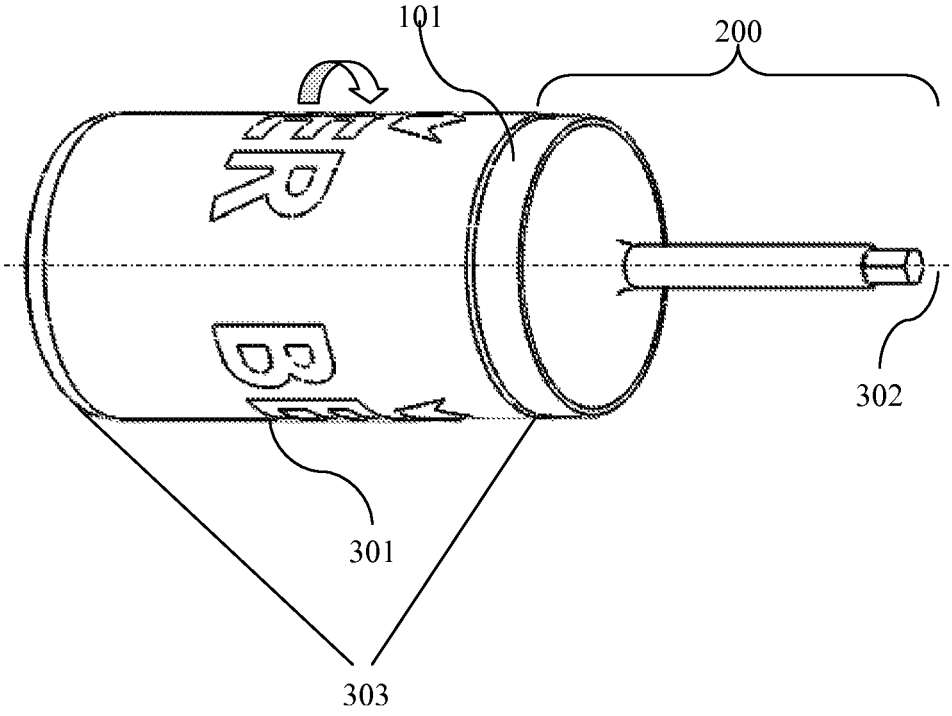
FIG. 6 provides a side profile view of a 200 drill bit assembly whereby a 301 container is being connected to said 101 cylindrical sleeve from a 303 distal end, and said 301 container is being spun horizontally about its 302 longitudinal axis.

As used herein, "distal end" shall mean the top end or bottom end of a container as illustrated at 303 in FIG. 3 and FIG. 6. It should be appreciated that distal end may either be the top end, the bottom end, or both. In the instance where a bottle may be used whose top end is substantially smaller than the bottom end (such as a glass beer bottle or plastic soda bottle), the preferred distal end is the bottom end. However, it should be appreciated that a cylindrical sleeve may be fabricated to fit the top end of a bottle, and the inventive methods and devices would work similarly.

As used herein "top end" shall mean when viewed in reference to labels, and logos, and assuming a substantially cylindrical container (such as can or bottles), the furthermost upright end of the container, typically the side of the container where a user drinks from.

As used herein "bottom end" shall mean when viewed in reference to labels, and logos, and assuming a substantially cylindrical container (such as can or bottles), the furthermost lower end of the container, typically the side of the container used to set the container on an object.

As used herein "longitudinal axis" shall mean the lateral axis of a container, as illustrated at 302 in FIG. 3 and FIG. 6. It should be appreciated that a cylinder has a top end having a radius, a bottom end having a radius and a lateral end of a certain height or length. For example, a 12 ounce aluminum can has the typical dimensions of 4.5 inches high, with the top end and bottom end having a radius of 1.25 inches, thus the 302 longitudinal axis is that axis that runs from the top of the can to the bottom of the can, running the length of the entire height of the can. Thus it should be appreciated that spinning a can about its 302 longitudinal axis, as illustrated in FIG. 3 and FIG. 6 shall mean rotating a can from its top end or bottom end, and not rotating a can end over end.

As used herein "horizontally" shall refers to a containers position relative to the lateral side. For example, if a container is resting or being spun horizontally, the container should be viewed as though it is lying with its lateral sides as the top and bottom, while the top end and bottom end are on the sides.

As used herein, "vertically" shall refer to a containers position relative to the top end or bottom end. For example, if a container is resting or being spun vertically, the container should be viewed as though the can is resting on its top or bottom end with the lateral side being the height of the container relative to the top and bottom ends.

As used herein, "drill" shall mean an industrial or construction tool typically used for driving screws into a medium, such as wood or metal. A drill may include a wire to be powered directly from an outlet, or may be cordless and being powered by a battery.

As used herein, "counter-motive force" shall mean the force necessary to prevent the motor from spinning freely atop a container. It should be appreciated that the counter-motive force may be applied through the use of a handle or some other means against a rigid surface.

As used herein, the "mouth" of a can or bottle shall mean the open end of a can or bottle. Specifically, as it relates to bottles, the "mouth" of a bottle shall mean the open end of the bottle, usually much narrower than the remainder of a bottle, and having a neck, from which a person may extract or drink the contents of the container. As it relates to a can, the "mouth" of a can shall mean the open end of the can, typically the top end of the can.

As used herein, the "clip" shall mean an apparatus for holding the distal end of the container affirmatively, or positively mechanically engaging, into a cylindrical sleeve, usually by a ring or other physical surface on a container. For example, as it relates to cans, it should be appreciated that the top end of a can contains a radial ring of folded aluminum, as a result of the manufacturing process of the can. For such can, a can clip contains grooves or otherwise an undercut area which firmly slips over the radial ring of the can, positively engaging the can within the cylindrical sleeve and preventing the can from slipping out of the cylindrical sleeve. As it relates to bottles, typically a bottle contains a ring of material (glass or plastic) on the neck of the bottle immediately beneath the mouth of the bottle. For such bottles, a bottle clip contains grooves or otherwise an undercut area which firmly slips over the neck ring of said bottle holding the bottle snugly within the cylindrical sleeve and preventing the bottle from slipping out of the cylindrical sleeve.

The present invention contains the features of the container spinning device and methods of use as herein described.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4

Cylindrical Sleeve

Figure 1A:
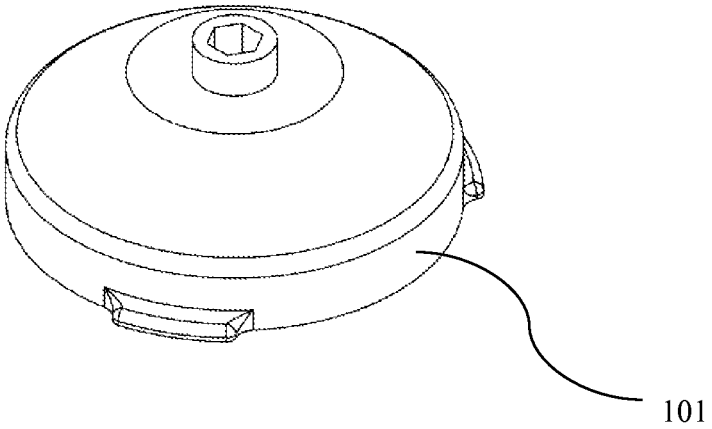
FIGS. 1A-1C provide a cross-sectional view of the 101 cylindrical sleeve used for holding the distal end of a cylindrical container.
Figure 1B:
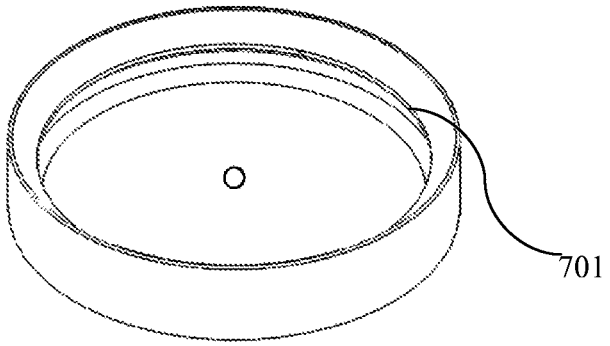
Figure 1C:
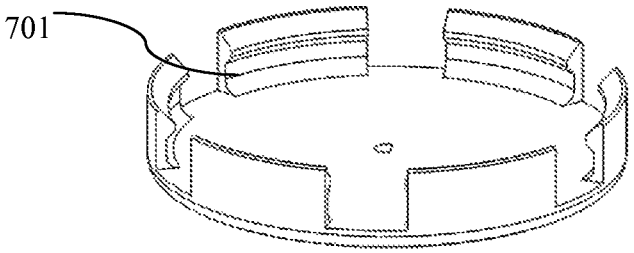

FIGS. 1A-1C provide a cross-sectional view of the 101 cylindrical sleeve used for holding the distal end of a 301 cylindrical container. The 101 cylindrical sleeve is intended to slide over the distal end of a 301 container, positively engaging the 301 container within the 101 sleeve. In at least one embodiment, the 301 container is surrounded and in contact with ice, thus providing a resistance to the 301 container when being spun. In at least one embodiment, the 301 container is surrounded by hot water. FIG. 1A represents the top view of the 101 cylindrical sleeve, illustrating where a 101 cylindrical sleeve may be connected to one end of a 201 shaft. FIG. 1B represents the bottom view of at least one 101 cylindrical sleeve illustrating grooves for positively engaging a container, while FIG. 1C represents the bottom view of at least one 101 cylindrical sleeve without grooves.

In at least one embodiment, the 101 cylindrical sleeve should prevent slip through friction when the 301 container undergoes resistance to a heating or cooling medium. In at least one embodiment the 101 cylindrical sleeve can be made of one or more of several materials, said materials including, wood, plastic, rubber, a polymer, a polyurethane, a latex, a nitrile, a poly-vinyl chloride (PVC), or combinations or equivalents thereof. In at least one embodiment, the 101 cylindrical sleeve is made with polycarbonate plastic center surrounded by the softer plastic PVC, whereby said plastic center provides a strong and rigid center that allows for the connection of said 101 cylindrical sleeve to the first end of a 201 shaft. It should be appreciated that many alternative materials exist that may provide such a benefit, and any combination of materials may be used to provide a rigid center with a flexible sleeve of said 101 cylindrical sleeve.

The 101 cylindrical sleeve can be made to fit over 301 containers of several sizes. One or several 101 cylindrical sleeves can be made to fit over 301 containers of several sizes. Examples of 301 containers include 8 ounce cans, 12 ounce cans (such as aluminum soda cans or aluminum beer cans), 16 ounce cans, 12 ounce bottles (such as glass beer bottles, glass soda bottles, or plastic baby bottles), 14 ounce bottles, 16 ounce bottles, 750 milliliter bottles (such as wine bottles or liquor bottles), 1 liter bottles (such as soda containers or liquor bottles), and 2 liter bottles. Depending on the material the 101 cylindrical sleeve in either FIG. 1B or FIG. 1C may be used to hold various sized 301 containers. In at least one embodiment a 101 cylindrical sleeve is made specifically to hold only one size 301 container. In at least one embodiment a single 101 cylindrical sleeve is made to hold a multitude of varying sized 301 containers. In at least one embodiment, the 101 cylindrical sleeve may be an adjustable 101 cylindrical sleeve that may be adapted to hold any sized 301 container. In at least one embodiment a single 101 cylindrical sleeve is made to hold a multitude of varying sized 301 containers from 1.5 inches to 3.5 inches in diameter.

Figure 7:
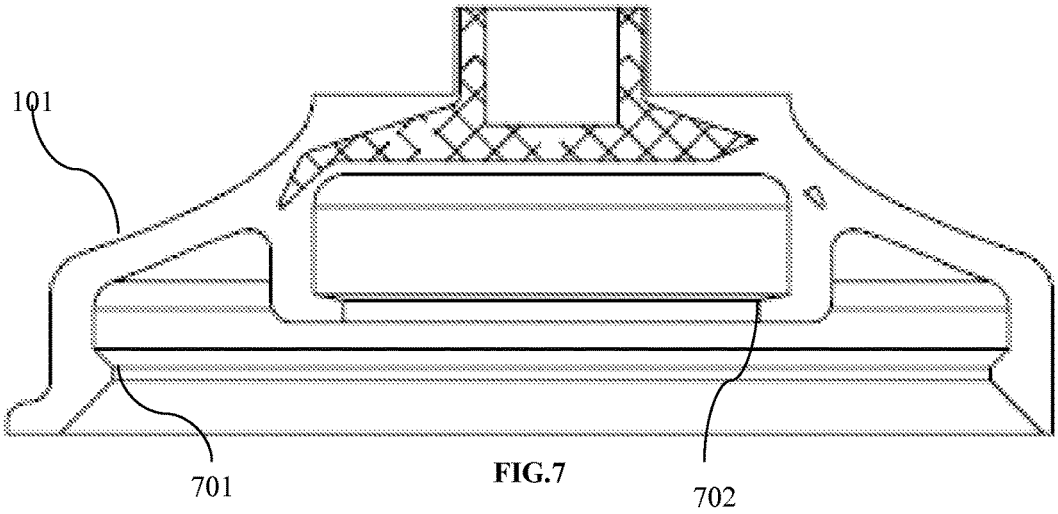
FIG. 7 provides a side profile cutaway view of a 101 cylindrical sleeve which has a 701 can clip and a 702 bottle clip.

FIG. 7 provides a side profile cutaway view of a 101 cylindrical sleeve which has a 701 can clip and a 702 bottle clip. In at least one embodiment the 101 cylindrical sleeve contains a 701 can clip which slips over and affirmatively grasps the radial ring located on the radial side of the top end of a can, typically include a ring of folded metal as a result of the manufacturing process of the can. Said 701 can clip contains grooves or otherwise an undercut area which firmly slips over the radial ring of the can, holding the can snugly within the 101 cylindrical sleeve, said 701 can clip preventing the can from slipping out of the 101 cylindrical sleeve. In at least one embodiment the 101 cylindrical sleeve contains a 702 bottle clip which slips over and affirmatively grasps the radial ring located on the on the neck of the bottle immediately beneath the mouth of the bottle. Said 702 bottle clip contains grooves or otherwise an undercut area which firmly slips over the neck ring of said bottle holding the bottle snugly within the 101 cylindrical sleeve and preventing the bottle from slipping out of the 101 cylindrical sleeve. In at least one embodiment, the 101 cylindrical sleeve contains both a 701 can clip and a 702 bottle clip.

Portable Shaft and Sleeve Assembly

Figure 2:
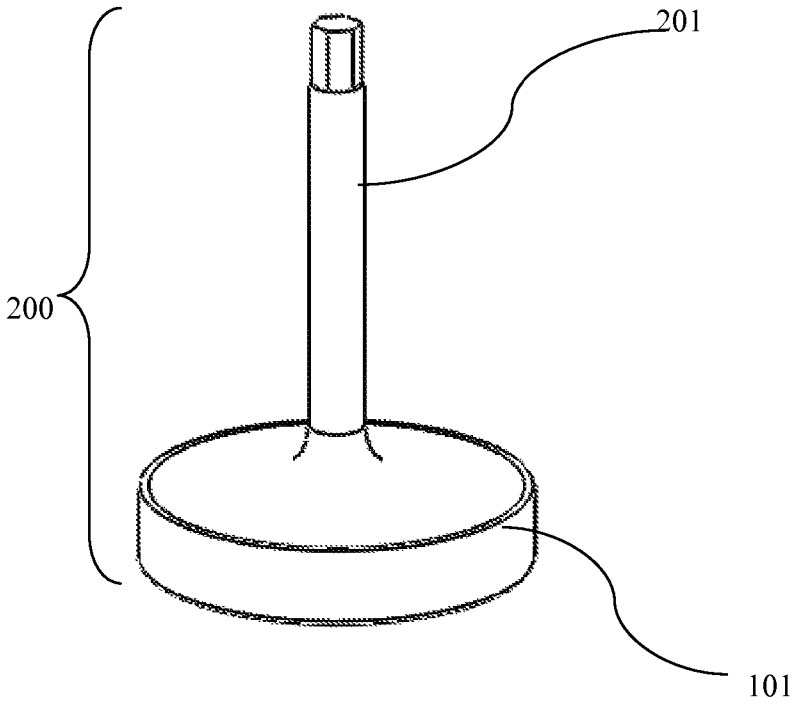
FIG. 2 illustrates a side profile view of a 200 drill bit assembly which includes a 101 cylindrical sleeve and a 201 shaft having two ends, the first end of said 201 shaft connected to said 101 cylindrical sleeve, while the second end of said 201 shaft is capable of being connected to a drill.

FIG. 2 illustrates a 200 drill bit assembly which includes a 101 cylindrical sleeve and a 201 shaft having two ends, the first end of said 201 shaft connected to said 101 cylindrical sleeve, while the second end of said 201 shaft is capable of being connected to a drill. The 200 drill it assembly provides for a portable tool that can be used at most construction sites. It should be appreciated that both power receptacles and space is limited at a construction site, thus providing a 200 drill bit assembly allows the end user the ability to incorporate a small and easily transportable accessory to accompany tools that are typically common amongst a construction site. In as far as overcoming an existing need, it is common for a construction workers bottle of water to be left out, or to be served a warm beverage from a vending machine, despite the construction worker having a cooler with ice to keep their lunch cold. Thus, the 200 drill bit assembly provides a portable apparatus which may be connected to a drill for spinning a 301 container to affect the heat transfer or affect the rate of heat transfer.

FIG. 3 illustrates a 200 drill bit assembly being spun about its 302 longitudinal axis vertically, while FIG. 6 illustrates a 200 drill bit assembly being spun about its 302 longitudinal axis horizontally. As provided, the 301 container is being connected to said 101 cylindrical sleeve from a 303 distal end, and said 301 container is being spun about its 302 longitudinal axis.

In addition, a construction worker may want to rapidly heat up a can of soup prior to eating it from the can. In this scenario, the user may connect a can of soup to the 101 cylindrical sleeve, employ the 200 drill bit with the users drill, and expose the 301 container to a heat source, thus rapidly heating up the can of soup to the desired temperature, and limiting the number of items or appliances needed for a construction worker to eat a meal to their desired temperature preference.

Portable Device with Motor

Figure 4A:
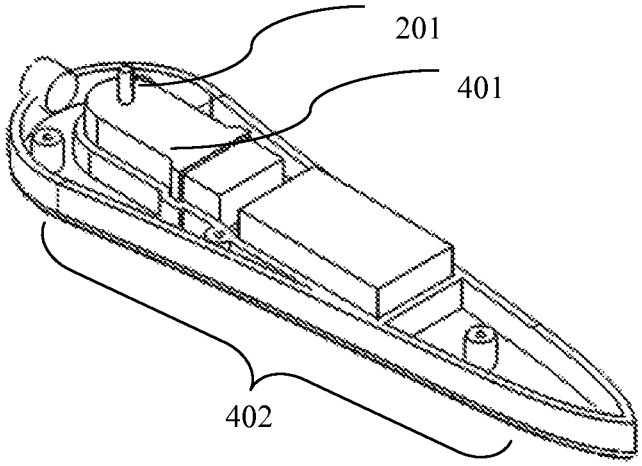
FIGS. 4A-B provide a cross-sectional component view of the 403 motor assembly.
Figure 4B:
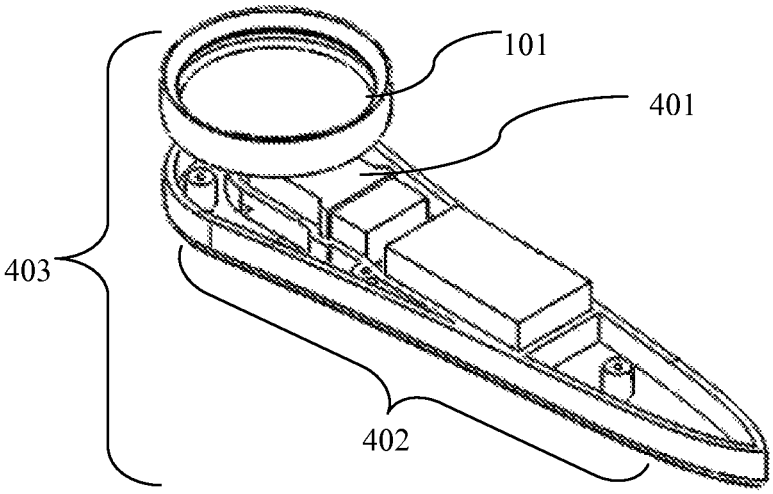
Figure 5:
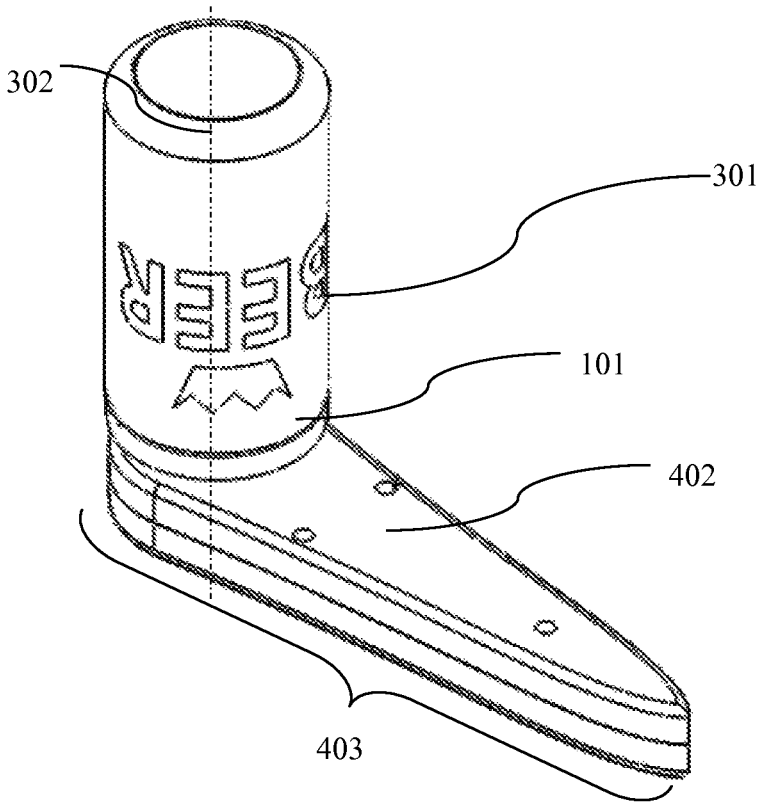

FIGS. 4A-B provide a cross-sectional view of the 403 motor assembly illustrating a 101 cylindrical sleeve connected to a first end of the 201 shaft, while the second end of said 201 shaft is connected to a motor, forming a 403 motor assembly. FIG. 4A represents a 201 shaft having two ends, the second end of said 201 shaft connected to a 401 motor having a 402 handle for providing counter-motive force. Said 402 handle may be straight, 'L'-shaped, or shaped such that the handle may provide a counter-motive force, irrespective of whether the container is sitting vertically, horizontally, or somewhere in between, thus preventing the 401 motor from spinning freely atop the 301 container. In at least one embodiment, the counter-motive force is applied to the 402 handle by a user holding said 402 handle. In at least one embodiment, the counter-motive force is applied to the 402 handle by the cooling medium in which the 403 motor assembly is placed. FIG. 4B represents the 403 motor assembly, as fully assembled, having a 101 cylindrical sleeve connected to a first end of a 201 shaft, and a 401 motor connected to a second end of the 201 shaft, said 403 motor assembly having a 402 handle for providing counter-motive force. When the 403 motor assembly is used in connection with a container, the container is connected to the 101 cylindrical sleeve which is connected to the 401 motor through the use of the 201 shaft. FIG. 5 provides a cross-sectional, fully assembled, view of the 403 motor assembly having a 402 handle in use with a 301 container inserted into the 101 cylindrical sleeve. The 403 motor assembly may be used to spin a 301 container about its 302 horizontal axis from a 303 distal end of a container either horizontally, vertically, or some angle in between. It should be appreciated that multiple 101 cylindrical sleeves with a 201 shaft may be connected to a motor, such that a 403 motor assembly may contain two or more 101 cylindrical sleeves used for affecting the heat transfer of two or more containers.

Method of Affecting Heat Transfer

The present invention further provides a method of affecting heat transfer to a container using the 200 drill bit assembly or the 403 motor assembly. The method for heating or cooling a container using the 200 drill bit assembly or the 403 motor assembly, requires inserting a distal end of a 301 container in to said 101 cylindrical sleeve. The 301 container may be of varying sizes as described herein. The 301 container is then exposed to heating or cooling source and the 200 drill bit assembly or the 403 motor assembly is operated by its spinning device. In the case of the 200 drill bit assembly, the spinning device is a drill. In the case of the 403 motor assembly, the spinning device is the 401 motor.

In any embodiment of the described invention, said 301 container is rotated about its horizontal axis as a result of the frictional force between the 101 cylindrical sleeve to the 301 container while said 301 container is being exposed to said heating or cooling source. The 301 container is prevented from spinning within the 101 cylindrical sleeve when a resistance is applied from said heating or cooling source as a result of said frictional force of the 101 cylindrical sleeve overcoming the slip force created by the resistance on the 301 container.

It should be appreciated that the 301 container may be spun at any speed, measured in revolutions per minute (RPM), to affect heat transfer in the container. The spinning of the 301 container against a heating or cooling source adds a mechanism of convective heat transfer through the conducting layer of the container. In the sense of beverages, the laminar flow created by spinning the liquid about the longitudinal axis of the 301 container provides a convective heat transfer within the container, while greatly improving the conductive heat transfer across the container surface. The process of convection increases the temperature gradient through the walls of the container which allows the heat energy to flow more rapidly out of the container, resulting in cooling the container and fluid in a shorter amount of time. Thus, it should be appreciated that the rate of heat transfer may be varied by adjusting the speed at which a can is spun. In at least one embodiment, the 301 container is spun by its 303 distal end about its 302 longitudinal axis. The 301 container is spun either horizontally or vertically in relation to the surface of the heating or cooling medium. In at least one embodiment, the 301 container is spun between 50-1500 RPM's. In at least one embodiment, the 403 motor assembly uses a switch or a rheostat to allow a user to vary the speed of spinning the 301 container in the heating or cooling medium.

In at least one embodiment, the method employs the use of cold water, ice, snow, ice shavings, ice blocks, freeze gels, ice slurry, or a saltwater and ice slurry as a cooling medium. In at least one embodiment the method employs the use of hot water, steam, a blanket, or a source of radiative heat transfer such as a furnace, oven, or an electric heater. In at least one embodiment where a blanket is used the 301 container is spun within the blanket, the user applying some amount of resistance from the blanket to the 301 container, thus the friction created by spinning the 301 container with the 403 motor assembly creates a conductive heat source to the container.

The drawings and diagrams shown herein depict example arrangements of elements of the apparatus and method. More or less than all the features available or contemplated may be present in an actual embodiment. It should also be understood that FIGS. 1-7 are merely illustrative and may not be drawn to scale.

EXAMPLES

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

Example 1

An apparatus is used including a cylindrical sleeve attached to a first end of a shaft to form a drill bit assembly. The distal end of a 12 ounce can of soda at room temperature (78 degrees Fahrenheit) is inserted into the cylindrical sleeve, and the second end of the shaft is inserted into a drill. The user vertically submerges the 12 ounce can into ice and powers on the drill at maximum RPM's for that drill for approximately one minute. After the minute has passed, the user removes the can from the cylindrical sleeve, opens the container and checks the temperature to be at or near 40 degrees Fahrenheit.

Example 2

A user uses the apparatus as exemplified in Example 1, wherein the cylindrical sleeve further has a bottle clip and the container attached to the apparatus is a 750 milliliter wine bottle. The mouth of the wine bottle is inserted into the bottle clip of the cylindrical sleeve and the user submerges the wine bottle into a container having ice and powers on the drill at maximum RPM's for that drill for approximately one minute, cooling said wine bottle from room temperature to 34 degrees Fahrenheit.

Example 3

A user uses the apparatus as exemplified in Example 1, however the container attached to the apparatus is a 750 milliliter wine bottle. The bottom end of the wine bottle is inserted into the cylindrical sleeve and the user vertically submerges the wine bottle into a container having ice and powers on the drill at maximum RPM's for that drill for approximately one minute.

Example 4

An apparatus is used including a cylindrical sleeve attached to a first end of a shaft, where the second of the shaft is connected to a motor, the combination forming a motor assembly, whereby the motor assembly includes a handle which provides a counter-motive force to the motor when either held by a users hand, or is rested against a surface. The distal end of a 12 ounce can of beer at room temperature (78 degrees Fahrenheit) is inserted into the cylindrical sleeve. The user vertically submerges the 12 ounce can into ice and powers on the motor while holding the motor handle with the users hand for approximately one minute. After the minute has passed, the user removes the can from the cylindrical sleeve, opens the container and checks the temperature to be at or near 38 degrees Fahrenheit.

Example 5

A user uses the apparatus as exemplified in Example 4; however the container is submerged at a 10 degree angle from horizontal in a container of ice. The user sets down the handle and powers on the motor assembly. The motor handle initially moves about half a revolution until the handle rests firmly against the ice surface providing a counter-motive force to the motor assembly, whereby the can is spun instead of the motor assembly as a result of the counter-motive force. It should be noted that the handle momentarily spins due to the initial placement of the motor, thus illustrating that the apparatus may be setup without regard to the initial handle position, and that the handle will automatically adjust its position to provide the necessary counter-motive force to prevent the motor from spinning freely irrespective of its initial position Example 6

An apparatus is used including a cylindrical sleeve with a can clip, said cylindrical sleeve attached to a first end of a shaft, where the second end of the shaft is connected to a motor, the combination forming a motor assembly, whereby the motor assembly includes a handle which provides a counter-motive force to the motor when either held by a users hand, or is rested against a surface. The mouth of an open 12 ounce can of beer at room temperature (78 degrees Fahrenheit) is inserted into the cylindrical sleeve. The user submerges the 12 ounce can into ice and powers on the motor for approximately one minute. After the minute has passed, the user removes the can from the cylindrical sleeve, opens the container and checks the temperature to be at or near 38 degrees Fahrenheit. During the spinning process, none of the contents of the open can are spilled from the container as a result of the seal formed by said cylindrical sleeve.

Example 7

An apparatus is used including multiple sleeve and shaft assemblies, each assembly including a cylindrical sleeve with a can clip attached to a first end of a shaft. Each sleeve and shaft assembly is connected to its individual motor, where several motors are individually and rigidly mounted to a platform. Enough space between the motors are provided such that sufficient space between containers is available, when attached to the cylindrical sleeve, such that the containers will not come in contact with one another. A container is connected to each cylindrical sleeve, and the multiple containers connected to the apparatus are then submerged in ice. The motors are subsequently energized, thus each motor spinning an individual can. After approximately one minute has passed, the motors are de-energized, and the containers are removed from the ice and apparatus and temperature is measured to be at or near 38 degrees Fahrenheit. Several experiments are run with varying number of motors with negligible differences in results. This example was performed for the apparatus containing 2 motors to 8 motors at once, where each motor was connected to a sleeve and shaft assembly, and each cylindrical sleeve was holding a container.

Example 8

Example 7 was repeated, except that instead of individual motors, each shaft of the sleeve and shaft assembly was connected to a pulley, and the multiple pulleys were connected to each other by a belt, all rigidly mounted to a platform, forming a pulley system. A single motor is used to drive the belt of the pulley system, thus spinning each shaft and sleeve assembly individually. After approximately one minute has passed, the motor is de-energized, and the containers are removed from the ice and apparatus and temperature is measured to be at or near 38 degrees Fahrenheit. Several experiments are run with varying number of motors with negligible differences in results. This example was performed for the apparatus containing 2 motors to 8 motors at once, where each motor was connected to a sleeve and shaft assembly, and each cylindrical sleeve was holding a container.

OTHER EMBODIMENTS

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. An apparatus used for accelerating heat transfer between a container and a surrounding medium accomplished by holding and rotating a container, the apparatus comprising:

a first cylindrical sleeve having two ends, a first end being a closed end and a second end being an open end, said open end having an initial diameter less than the diameter of the cylindrical sleeve forming a can clip for engaging one end of the container;

a second cylindrical sleeve extending from said inner surface of said first cylindrical sleeve, said second cylindrical sleeve having an inner diameter less than the diameter of the first cylindrical sleeve, said second cylindrical sleeve having two ends, a first end being a closed end which extends from the inner surface of the closed end of said first cylindrical sleeve and a second open end, said second open end forming a bottle clip for engaging a portion of a neck of a bottle; and a shaft centrally mounted to said first and second cylindrical sleeves, said shaft having two ends, a first end connected to said first and second cylindrical sleeves and a second end adapted to be connected to a rotating device.

2. The apparatus of claim 1, wherein said first and second cylindrical sleeve is made from natural rubber, latex rubber, nitrile rubber, polyurethane, poly vinyl chloride (PVC), copolymers of any of the aforementioned, or combinations thereof.

3. The portable apparatus of claim 1, wherein said rotating device is a motor, a drill, or a wheel.

4. The portable apparatus of claim 3, wherein said motor further comprises of a handle that extends perpendicular from said shaft.

* * * * *